United States Patent [19]

Périou et al.

[11] Patent Number: 4,541,258

[45] Date of Patent: Sep. 17, 1985

[54] LATCH, IN PARTICULAR FOR AN AUTOMOBILE VEHICLE DOOR

[75] Inventors: Pierre Périou, Cergy; Jean Dauvergne, Fosses, both of France

[73] Assignee: Compagnie Industrielle de Mecanismes, France

[21] Appl. No.: 355,494

[22] Filed: Mar. 8, 1982

[30] Foreign Application Priority Data

Mar. 10, 1981 [FR] France ..... 81 04708

[51] Int. Cl.[4] ..... E05B 51/02

[52] U.S. Cl. ..... 70/263; 70/275; 292/201; 292/216

[58] Field of Search ..... 70/263, 264, 275; 292/216, 201, 144; 91/446, 530, 531

[56] References Cited

U.S. PATENT DOCUMENTS

| | | | |
|---|---|---|---|
| 2,206,523 | 7/1940 | Anderson | 91/531 X |
| 2,298,776 | 10/1942 | Rhein | 292/144 |
| 2,888,287 | 5/1959 | Taylor | 70/263 X |
| 2,913,876 | 11/1959 | Reid | 91/531 X |
| 2,974,742 | 3/1961 | Tyler | 70/264 X |
| 3,021,912 | 2/1962 | Weymouth, Jr. | 70/264 X |
| 3,070,184 | 12/1962 | Riester | 70/263 X |
| 3,075,356 | 1/1963 | Fiala et al. | 91/530 X |
| 3,087,307 | 4/1963 | Faisandier | 91/530 |
| 3,090,644 | 5/1963 | Fiala et al. | 292/201 X |
| 3,110,353 | 11/1963 | Oishei et al. | 70/264 X |
| 3,111,184 | 11/1963 | Oishei | 70/264 X |
| 3,381,586 | 5/1968 | Rosenberg | 91/446 X |
| 3,443,483 | 5/1969 | Ruhl | 91/530 X |
| 3,633,391 | 1/1972 | Andres | 70/264 |
| 3,771,424 | 11/1973 | Allen et al. | 91/446 |
| 3,955,474 | 5/1976 | Dunn | 91/530 X |
| 3,961,670 | 6/1976 | Rivinius | 91/530 X |
| 3,971,241 | 7/1976 | Parsson | 70/275 |
| 3,982,469 | 9/1976 | Bianchetta | 91/531 X |
| 4,253,319 | 3/1981 | Feichtiger et al. | 70/264 |
| 4,273,027 | 6/1981 | Reinhard et al. | 70/264 X |
| 4,341,149 | 7/1982 | Dezelan | 91/531 X |
| 4,353,230 | 10/1982 | Cacioni | 70/263 X |

FOREIGN PATENT DOCUMENTS

| | | | |
|---|---|---|---|
| 624127 | 7/1961 | Canada | 91/531 |

*Primary Examiner*—Gary L. Smith
*Assistant Examiner*—Thomas J. Dubnicka

[57] ABSTRACT

Devices for controlling the unlatching and locking of the latch are hydraulic. Connected to a single unit having a plurality of slide valves are an expansion vessel, transmitting pumps controlling the unlatching, a receiving unlatching fluid motor and one or more pumps controlling the locking of the latch. Depending on which slide valves and pumps are employed, it is possible to achieve at will one or more of the various locking functions required in automobile vehicle latches.

6 Claims, 20 Drawing Figures

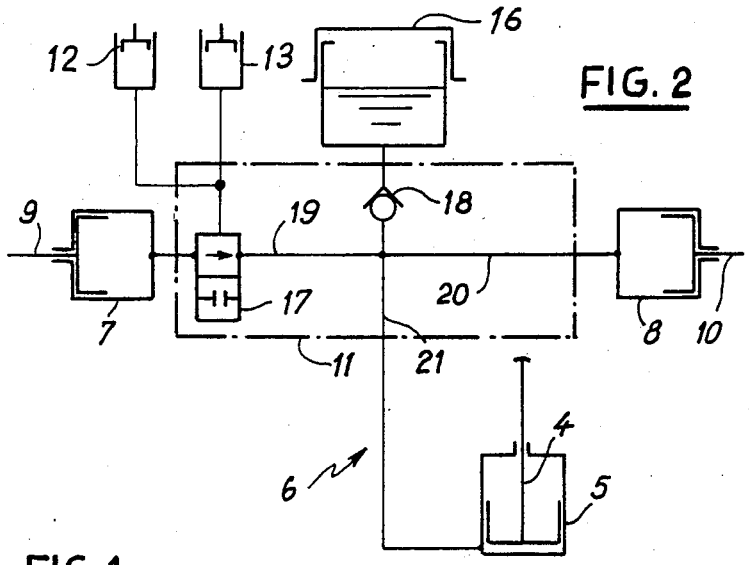
FIG. 2
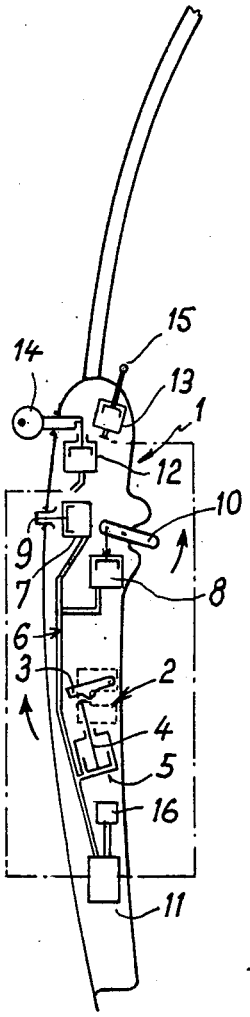
FIG. 1
FIG. 3
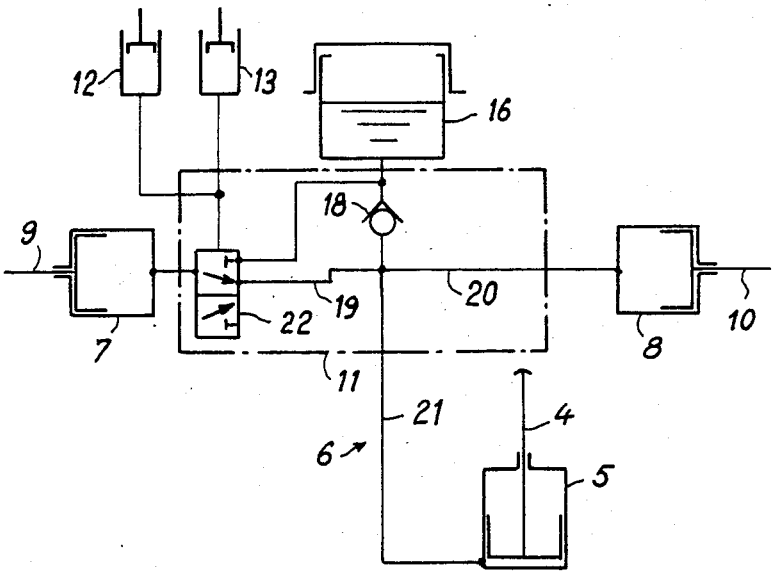

FIG. 4
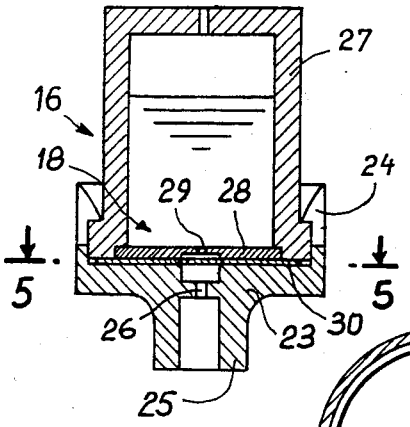
FIG. 6
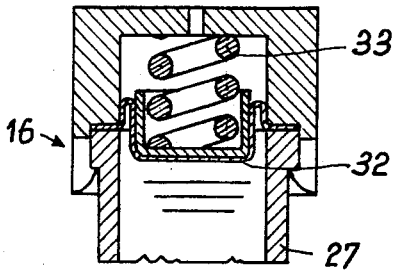
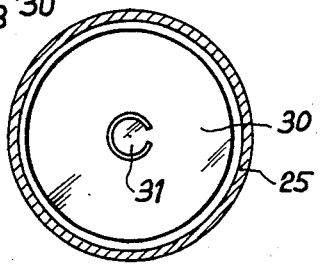
FIG. 5
FIG. 7
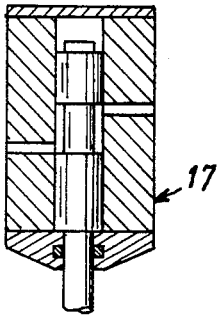
FIG. 8
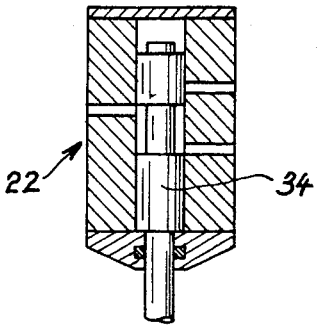
FIG. 9
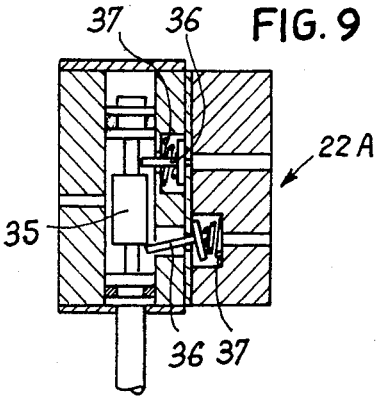
FIG. 10
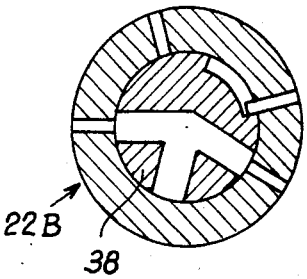

LATCH, IN PARTICULAR FOR AN AUTOMOBILE VEHICLE DOOR

DESCRIPTION

The present invention relates to a latch, in particular for an automobile vehicle door, of the type comprising a device controlling the unlatching and a locking device, at least one of which devices is part of a closed hydraulic circuit.

Known latches of this type, for example described in the U.S. Pat. Nos. 2,298,776 and 3,971,241, have a serious drawback which renders them practically unsuitable for use in automobiles in respect of which thermal specifications are very severe. Indeed, when these known latches are unlocked, the liquid which fills the circuit is enclosed in a fixed volume, so that there is a risk that the latch be accidentally actuated under the effect of the thermal expansion of this liquid.

An object of the invention is to provide a latch which permits, simply and cheaply, the liquid to expand freely under the effect of large variations in temperature without adversely affecting the operation of the considered device.

The invention consequently provides a latch of the aforementioned type, wherein the hydraulic circuit is provided with an expansion vessel with which there is associated a check valve which is adapted to permit the return of the liquid to the vessel only at very low flows.

When the latch according to the invention is adapted to be provided in an autombile door, it comprises an inner device for controlling the unlatching and an outer device for controlling the unlatching. Thus there may be envisaged several variants incorporating the various usually employed locking functions: unlocking by actuation of the inner unlatching control device; safety against actuation by children; prevention of locking with the door open and locking with the door open without a key by actuation of the outer unlatching control device.

Standardization can be achieved to a high degree when the locking device comprises a single unit provided with a plurality of directional valves and a system of conduits for the connection of a liquid reservoir, a desired number of transmitting pumps and at least one receiving shifting device for unlatching the latch.

The invention will be described hereinafter in more detail with reference to the accompanying drawings, which illustrate several embodiments. In the drawings:

FIG. 1 is a partial diagram of the placement of a latch according to the invention in an automobile door;

FIGS. 2 and 3 are diagrams of the principle of operation of two embodiments of the hydraulic circuit of this latch;

FIG. 4 is a sectional view of an expansion vessel of this circuit;

FIG. 5 is a sectional view taken on line 5—5 of FIG. 4;

FIG. 6 is a partial sectional view of a modification of the expansion vessel;

FIGS. 7 to 10 are sectional views of several embodiments of directional valves which may be employed in the circuits of FIGS. 2 and 3;

Figure 16:
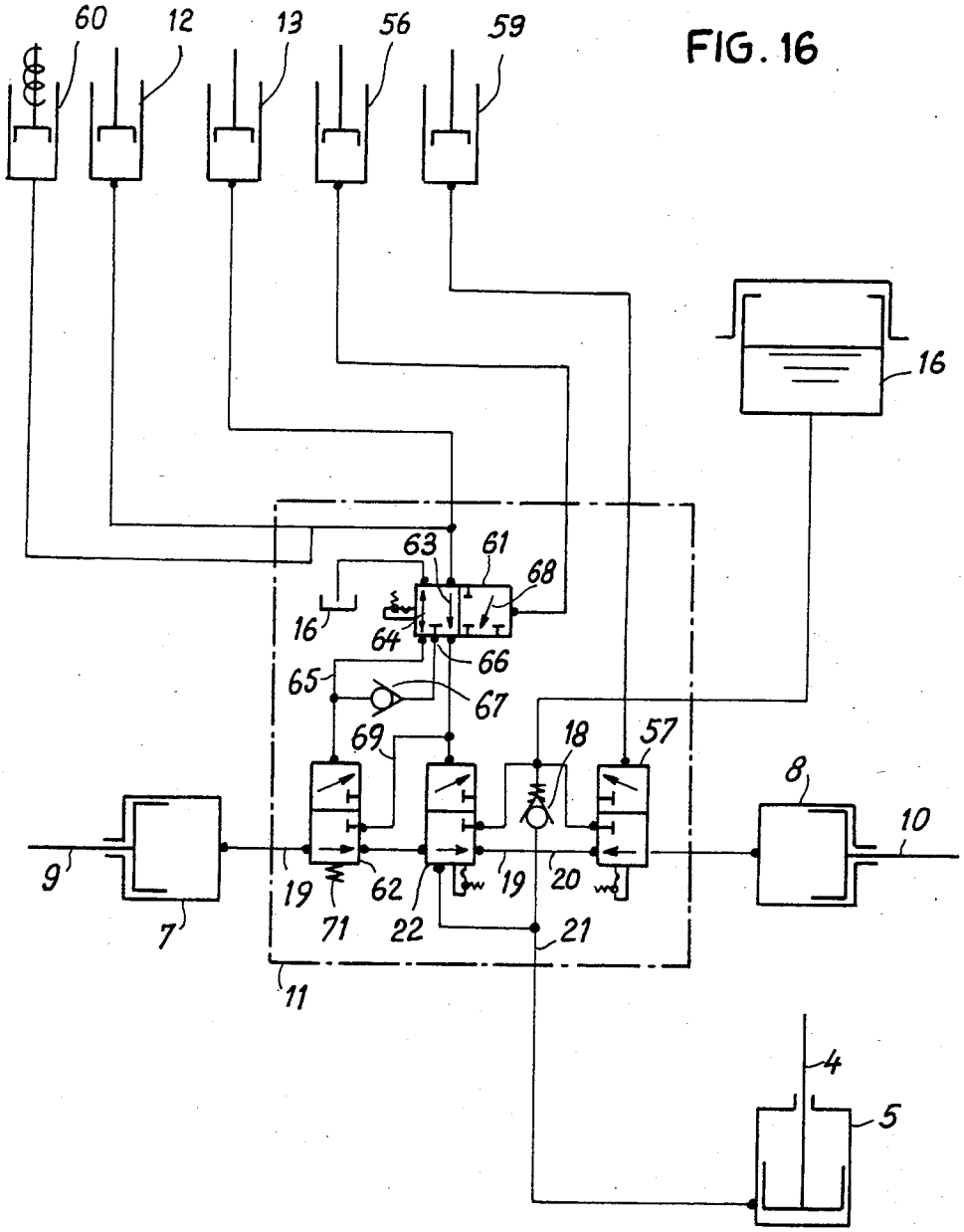
FIG. 16 is a similar diagram of a "universal" control for automobile door latches according to the invention.
Figure 17:
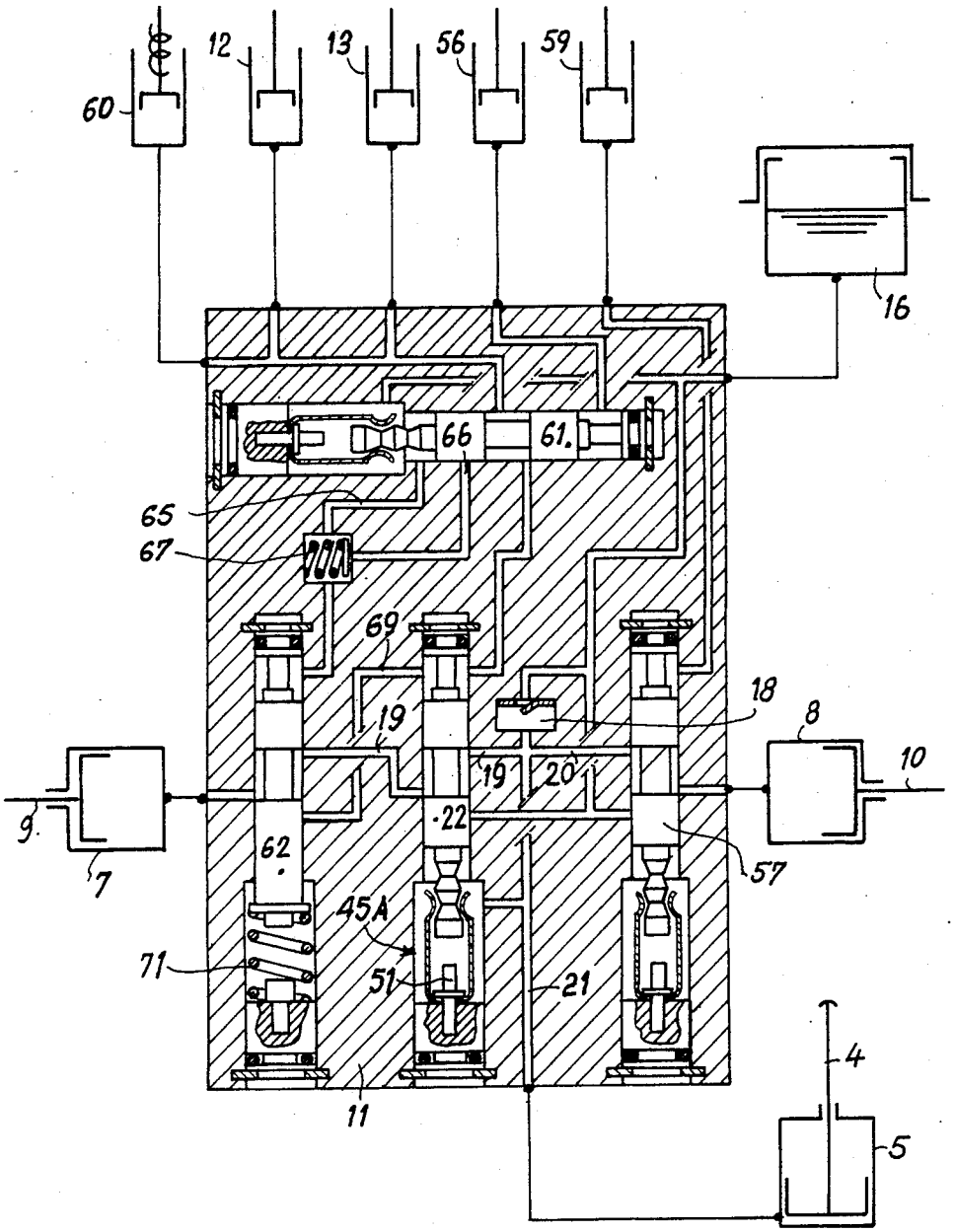
Figure 18:
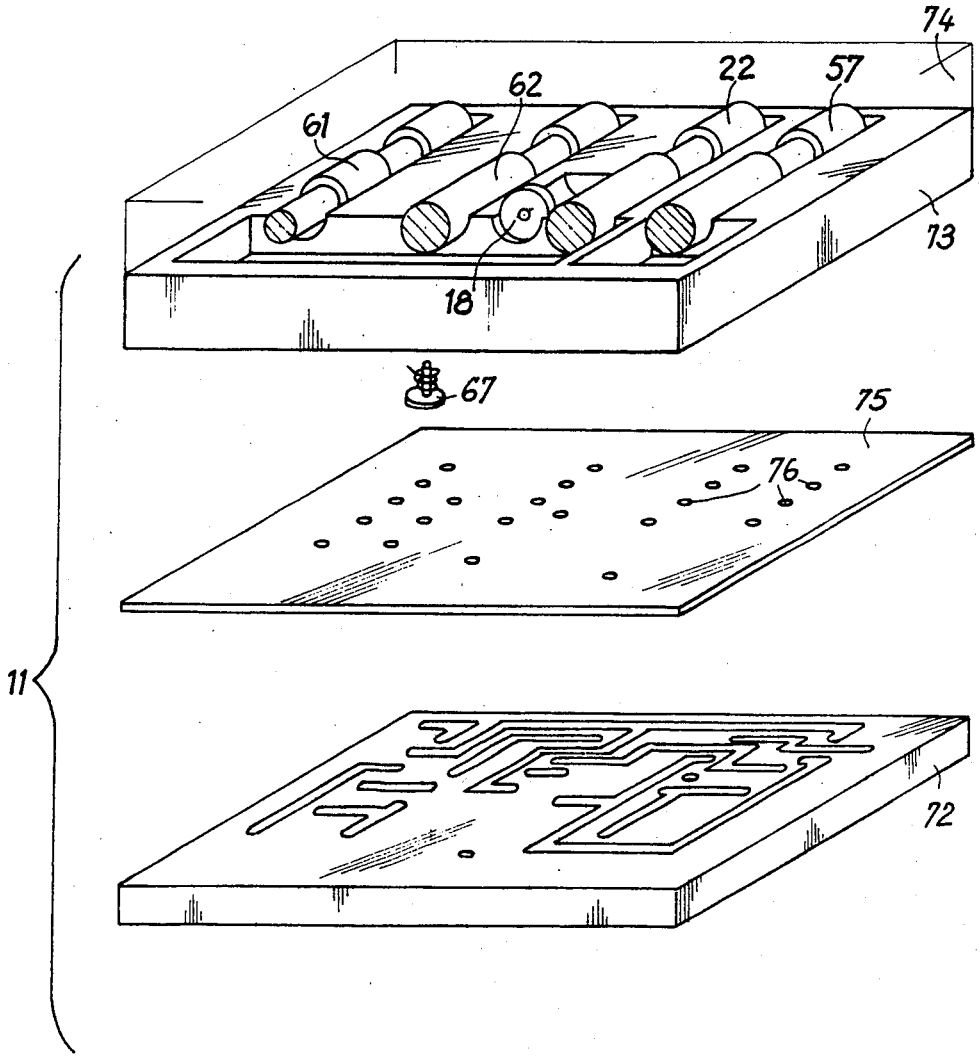
Figure 19:
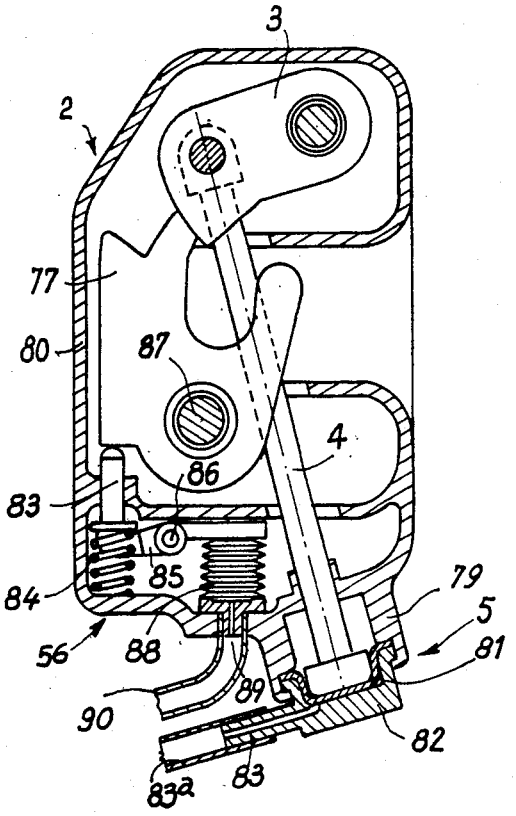

FIG. 17 diagrammatically illustrates a practical embodiment of the diagram of FIG. 16;

FIG. 18 is an exploded perspective view of a modification of the embodiment of FIG. 17;

FIG. 19 is a sectional view of a latch according to the invention, and

Figure 20:
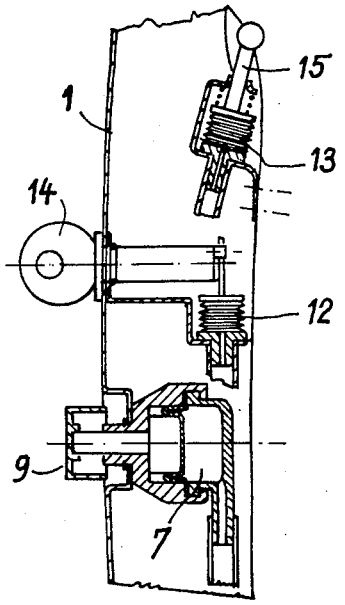

FIG. 20 is a partial diagram of the placement of a latch according to the invention in an automobile door.

FIG. 1 shows an automobile door 1 in the thickness of which there is mounted a fully hydraulically controlled latch 2. The unlatching means 3 of this latch is driven by the rod 4 of a shifting device or fluid motor 5 connected to a hydraulic circuit 6 which contains a liquid such as a mixture of water and an anti-freeze liquid. Connected to this circuit are two pumps 7, 8 which are respectively actuated by an outer knob 9 and an inner knob 10 controlling the unlatching, and a locking device, diagrammatically represented by a unit 11, to which are connected two pumps 12, 13 which are respectively actuated by an outer key 14 and an inner window frame pull-member 15, as illustrated in dot-dash lines. The whole of the circuit 6 is a closed circuit comprising expansion vessel 16 and is disposed within the door 1.

The pumps 7, 8, 12 and 13 may be, for example, of the cylinder and piston type, of the unrolling diaphragm type or of the bellows type. It will be assumed hereinafter that these pumps are of the cylinder and piston type.

FIG. 2 shows a simple embodiment of the circuit 6 which ensures solely the unlatching and the locking of the outer unlatching control. The unit 11 comprises a directional valve 17 having two positions and two ways, and a check valve 18 whose input is connected to the expansion vessel 16 and whose output is connected to the output of the directional valve 17 by way of a conduit 19. The input of the directional valve is connected to the output of the pump 7 and the shifting of the directional valve is controlled either by the pump 12 or the key 14 or by the pump 13 of the pull-member 15, these pumps being connected to the directional valve in parallel. Connected between the valve 18 and the directional valve 17 are two conduits, namely a conduit 20 which leads to the output of the pump 8 and a conduit 21 which leads to the input of the fluid motor 5.

In the opening position of the directional valve 17 shown in FIG. 2, the actuation of the knob 9 returns liquid to the fluid motor 5 by way of the conduits 19 and 21, which unlatches the latch. The latter is consequently unlocked. On the other hand, in the other position of the directional valve 17, this unlatching circuit is blocked so that it is impossible to actuate the knob 9. The latch is consequently locked. In both cases, the actuation of the inner knob 10 sends fluid to the fluid motor 5 by way of the conduits 20 and 21 and this unlatches the latch.

In order to avoid the risk of rupture resulting from such a locking by a blocking effect, it is preferable to employ a locking by means of an uncoupling illustrated in FIG. 3: the directional valve 17 is replaced by a directional valve 22 having two positions and three ways, an output of which valve is connected directly to the expansion vessel 16 and the other output of which is connected to the conduit 19. Thus, in accordance with the position of the directional valve, the actuation of the knob 9 sends liquid to the conduit 19 (latch unlocked) or to the expansion vessel 16 (latch locked).

Automobile vehicles may undergo considerable variations in temperature, for example from −40° to +80° C. Consequently, in order to avoid an accidental actuation of the latch 2, the liquid contained in the circuit 6 must be free to expand. This is why the circuit 6 includes the expansion vessel 16. Further, in order to permit the return of the expanding liquid to this expansion vessel, the check valve 18 is so designed as to check the flow of liquid only in the case of a sudden increase in the downstream pressure.

Consequently, the expansion vessel 16 comprises (FIGS. 4 and 5) a base 23 having the shape of a disc and provided on its upper side with elastically yieldable tabs 24, on its lower side with a connecting pipe 25 and in its center with an aperture 26 which is counterbored in its upper part. A reservoir 27, in the form of an inverted cup with an apertured end wall, is clipped in the tabs 24 and urges against the base 23 a plate 28 which has a small central aperture 29 having a counterbored in its lower part, and a diaphragm 30. The center part of the latter is cut out on three-quarters of a circle so as to define a flap valve 31. When the downstream pressure in the pipe 25 suddenly increases, the flap valve 31 closes the aperture 29, but when this pressure increases only slightly, in particular when the liquid contained in the circuit 6 expands, this flap valve remains spaced away from the aperture 29 and allows a small flow of liquid to the reservoir 27. The reservoir-valve assembly of FIGS. 4 and 5 corresponds to the vessel 16 and the valve 18 of FIGS. 2 and 3. The flap valve 31 allows the liquid to flow freely out of the reservoir 27.

In the embodiment shown in FIGS. 4 and 5, the reservoir 27 communicates with the atmosphere. As shown in FIG. 6, it may be advantageous, in a modification, to establish a certain overpressure in this reservoir and consequently in the whole of the circuit 6. This may be achieved by means of a diaphragm 32 biased by a spring 33 provided in the upper part of the reservoir 27.

FIGS. 7 to 10 show four types of directional valves which may be employed in the circuits 2 and 3. The directional valve 17 of FIG. 7 corresponds to the locking by a blocking action of FIG. 2, and the other three valves serve to lock the latch by an uncoupling as shown in FIG. 3. The directional valve 22 of FIG. 8 is of the type having a single slide valve member 34, the directional valve 22A of FIG. 9 is of the type having a slide 35 which actuates two inclinable valves members 36 which are biased to their closing position by springs 37, and the directional valve 22B of FIG. 10 is of the type having a rotary valve member or plug 38 and three ways.

Hereinafter, it will be assumed that devices are employed which lock the latch by an uncoupling by means of directional valves 22 of the type shown in FIG. 8.

Figure 11:
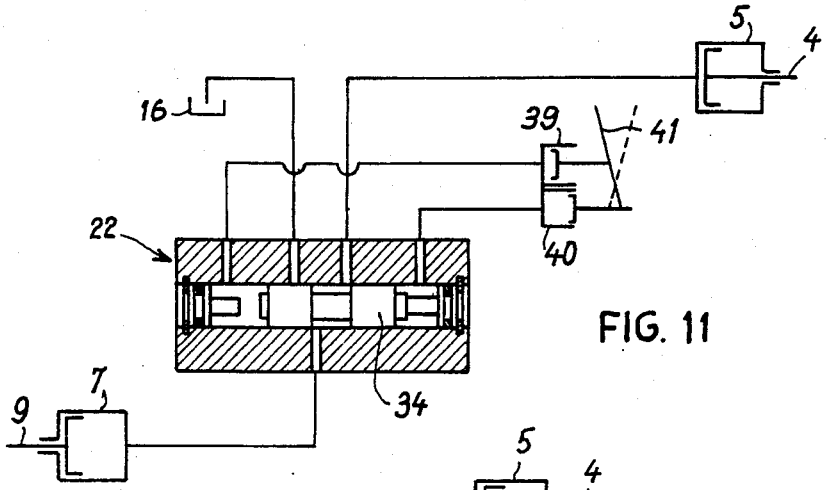
FIGS. 11 to 13 illustrate diagrammatically three embodiments of means for actuating a directional valve of the type illustrated in FIG. 8.
Figure 12:
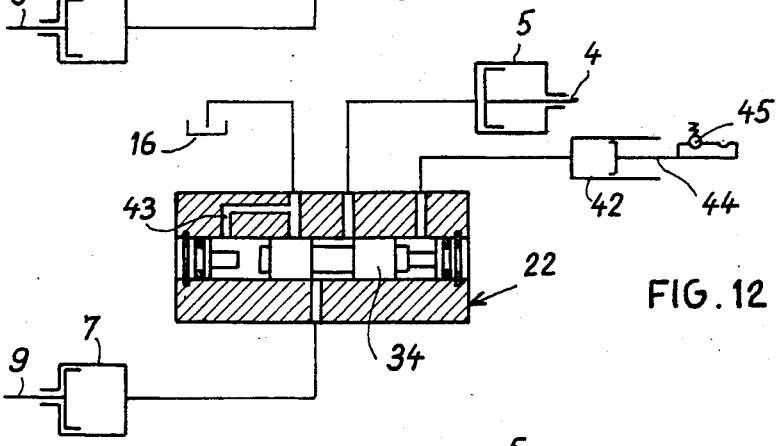
Figure 13:
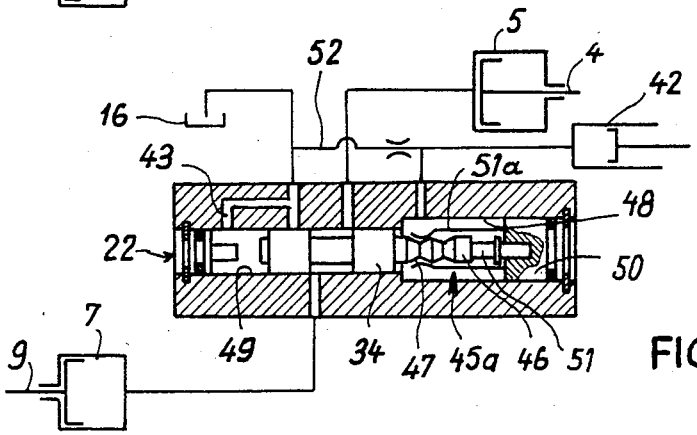

The hydraulic actuation of the directional valve 22 or each directional valve 22 may be achieved by one of the actuating devices which are diagrammatically respresented in FIGS. 11 to 13.

In FIG. 11, two identical pumps 39 and 40 are shifted in opposite directions and in synchronism by a common lever 41 and are connected respectively to the two ends of the body of the directional valve 22 so that, when one pump discharges liquid, the other takes in an equal amount of liquid. Note that the expansion and contraction of the liquid acts in a balanced manner on the pumps 39 and 40 and consequently there is no risk of accidentally actuating the directional valve.

In FIG. 12, a single pump 42 is connected to one end of the body of the directional valve 22 whose other end communicates by way of a conduit 43 of this body with the output of the directional valve which is connected to the vessel 16. The pump 42 discharges liquid into the first end of the directional valve or draws in liquid from this end, depending on its direction of displacement. The shifting rod 44 of this pump comprises a device 45 defining two stable positions, for example formed by a spring-loaded ball cooperating with two recesses which are formed in the rod 44 in spaced-apart relation. The force of the device 45 is chosen in such manner as to obviate the effects of the expansion and contraction of the liquid. Such a device may moreover be advantageously provided for the lever 41 of FIG. 11.

The preferred arrangement shown in FIG. 13 is similar to that of FIG. 12 except for the device 45A for maintaining the position. This device comprises an extension 46 of the slide valve member 34 which has two peripheral V-shaped grooves 47 and is received in a cavity 48 extending the main bore 49 of the directional valve. The end of the cavity 48 is closed in a sealed manner by a plug 50 from the inner face of which plug projects a center abutment 51 for the extension 46 and, on each side of this abutment, two spring strips **51*a* whose curved end portions are engageable in either of the grooves 47 for axially retaining the slide valve member 34**.

In this embodiment shown in FIG. 13, the pump 42 is furthermore connected through a constricted branch pipe 52 to the vessel 16 so as to ensure that the expansion or the contraction of the liquid trapped between this pump and the associated end of the directional valve does not accidentally actuate the latter. The pipe 52 also ensures the equalization of the pressures in the circuit after a short moment, of the order of a few seconds. This permits a push-knob which is spring biased to its neutral position to be employed for actuating the pump 42. It is then possible to connect in parallel a plurality of pumps such as 42 and it is ensured, provided correct dimensions are employed, that the actuation of these pumps does not change the position of the other pumps.

Hereinafter, it will be assumed that the locking directional valves are constructed in accordance with FIG. 13. In order to render the drawings more clear, the pipes 52 of these directional valves have not been changed in FIGS. 14 to 18.

Figure 14:
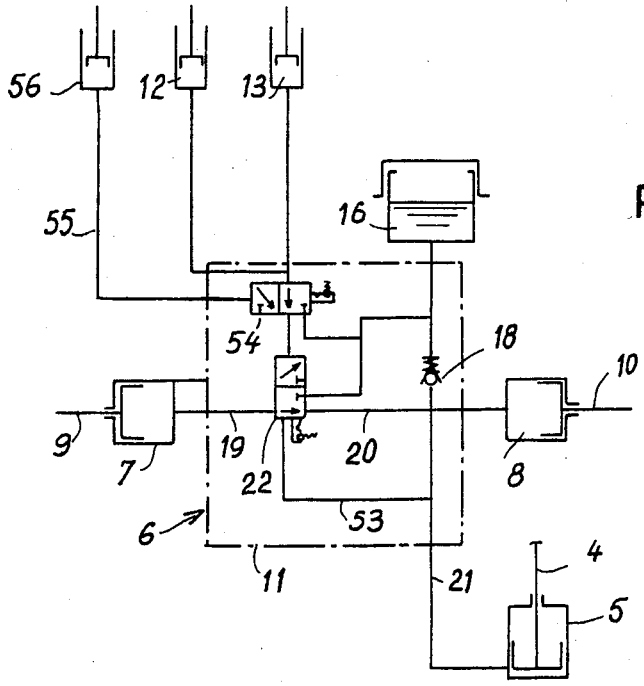
FIGS. 14 and 15 are diagrams of the principle of operation of latches according to the invention for the front and rear doors respectively of an automobile vehicle.

FIG. 14 is a diagram of a control for a front door latch of an automobile vehicle. Apart from the elements already described with reference to FIG. 3, the unit 11 comprises a conduit 53 which connects one end of the directional valve 22 of the conduits 20 and 21. Thus, the actuation of the inner knob 10 brings the directional valve to the unlocking position.

Note in this respect that it is possible to provide the unlatching control knobs 9 and 10 with a return spring so that these knobs deliver unlatching impulses by a mere depression thereof. Further, when the expansion vessel 16 is pressurized, this elastic return of the knobs 9 and 10 may be ensured by the pressure of the circuit 6 with no need for a return spring. In this case, the slow return of the knob 10 will not be liable to return the directional valve 22 to the locking position. In the opposite case, which is rare in automobiles, of a knob 10 having a positive return, the correct dimensioning of the hydraulic means will easily permit the avoidance of the return of the directional valve 22.

Furthermore, between the locking pumps 12 and 13 and the end of the directional valve 22 opposed to the conduit 53 is interposed another directional valve 54 of the same type. The input of the latter is connected to the pumps 12 and 13 which are connected in parallel. One of its outputs is connected to the directional valve 22 and its other output is connected to the vessel 16. One end of the directional valve 54 is connected by way of a conduit 55 to a pump 56 which is responsive to the latched or unlatched state of latch 2, for example responsive to the position of the latching means of this latch.

When the latch is not completely latched, the pump 56 brings the directional valve 54 to its position inhibiting a locking, in which position its input communicates with its second output and consequently with the vessel 16. The actuation of the key 14 or of the pull-member 15 is then inoperative in respect of the main directional valve 22 and the latter consequently remains in the unlocking position. This avoids closing an already locked door and forgetting the key inside the vehicle. The complete latching of the latch 2 causes the return of the directional valve 54 to its position allowing the locking illustrated in FIG. 14.

Figure 15:
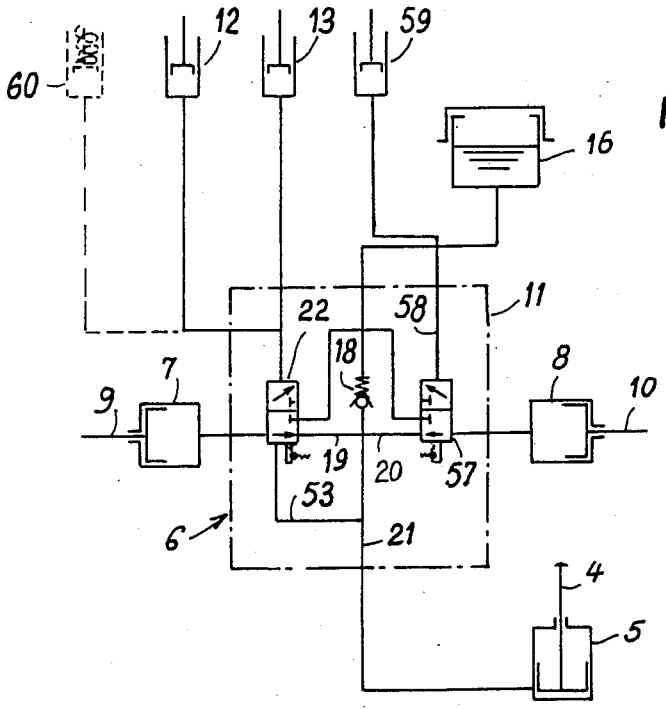

FIG. 15 shows a control for a rear door latch of an automobile vehicle. Apart from the elements already described with reference to FIG. 3, the unit 11 comprises, as in FIG. 14, the conduit 53 ensuring the unlocking by actuation of the inner knob 10. Further, a directional valve 57 similar to the directional valve 22 is inserted in the conduit 20. The input of this directional valve 57 and one of its outputs are connected to the conduit 20, and its other output is connected to the vessel 16 in a symmetrical manner relative to the directional valve 22. One end of the directional valve 57 is connected, through a pipe 58, to a manually actuated pump 59 termed a "child safety" pump, for example placed in the edge of the door. The actuation of the pump 59 thus permits locking the latch solely in respect of the inner knob 10, whereas the locking in respect of the outer knob 9 is still effected by means of a key (pump 12) or an inner frame pull-member (pump 13).

Instead of the key, or in addition thereto, in all the embodiments, it is also possible to control the directional valve 22 by means of an electrically actuated pump 60, as shown in dot-dash lines in FIG. 15. This pump 60 may in particular be common to all the latches of the vehicle and may belong to a centralized electric locking control device for these latches.

FIG. 16 shows a "universal" control for an automobile vehicle latch grouping all the locking functions ensured by the circuits of FIGS. 14 and 15 and an additional function of "locking without a key with the door open". The directional valve 54 of FIG. 14 is replaced by a more complex directional valve 61 having two positions and five ways, and an additional three-way directional valve 62 is inserted in the conduit 19 between the directional valve 22 and the pump 7.

In its stable position shown in FIG. 16, the directional valve 61 defines a passage 63 which connects all of the pumps 12, 13 and 60, which are connected in parallel, to the directional valve 22, a passage 64 which connects the vessel 16 to one end of the directional valve 62 by way of a conduit 65, and a blocked output 66 connected to an intermediate point of the conduit 65 through a check valve 67 which is directed towards this conduit. In the opposed position of the directional valve 61, only a passage 68 connecting the pumps 12, 13 and 60 to the output 66 remains open.

Further, the input and a first output of the directional valve 62 are connected to the conduit 19, whereas its second output is connected through a conduit 69 to the locking end of the directional valve 22. A spring 71 permanently biases the directional valve 62 towards its illustrated position in which its input communicates with its first output.

When the latch 2 is completely latched, the directional valve 61 is in its position allowing a locking illustrated in FIG. 16: the conduit 65 is connected to the vessel 16 and this permits the directional valve 62, under the effect of the spring 71, to put the pump 7 in direct communication with the input of the directional valve 22. The passage 63 enables the pumps 12, 13 and 60 to effect the locking and unlocking of the latch in respect of the outer knob 9.

When the latch 2 is not completely latched, the pump 56 brings the directional valve 61 to its position inhibiting a locking. When a pump 12, 13 or 60 is actuated in the locking direction, liquid under pressure passes through the passage 68 and the check valve 67 and reverses the position of the directional valve 62 without acting on the directional valve 22. The latch consequently remains unlocked. However, if the outer knob 9 is then actuated, liquid is sent through the directional valve 62 into the conduit 69 and this changes the position of the directional valve 22 and thus locks the latch in respect of the outer knob 9. Thus it is possible to lock the latch without a key, provided the latch is not completely latched. The locking as concerns the inner knob 10 is achieved by means of the "child safety" pump 59 and the associated directional valve 57 as in FIG. 15.

FIG. 17 shows diagrammatically a practical embodiment of the circuit shown in FIG. 16. The unit 11 is represented by a parallel-sided unit in which are provided all the conduits of FIG. 16, four bores receiving the four slide members of the directional valves 22, 57, 61 and 62, the maintaining devices 45A, of the type illustrated in FIG. 13, of the first three, and the spring 71 of the fourth, and two cavities receiving the check valves 18 (constructed as in FIG. 4 in order to permit the expansion of the liquid) and 67.

In all cases, the vessel 16, the outer pump 7 and inner pump 8 and the shifting device 5 are connected to the orifices of the corresponding conduits. In order to obtain a given series of locking functions among those described hereinbefore, it is sufficient to connect the corresponding pumps, among the pumps 12, 13, 56, 59 and 60, to the orifices of the corresponding conduits, the other orifices being sealingly closed by plugs (not shown) and the unused directional valves being locked in their position providing a direct passage, which is automatically the case for the directional valve 62 and can be achieved for the other three directional valves by a simple extension of their abutment 51.

In this way, it is possible to obtain very simply a front door control such as that shown in FIG. 14 or a rear door control such as that shown in FIG. 15. As the whole of the control has no critical orientation, it may be mounted either in a left door or in a right door. The degree of standardization is consequently very high.

FIG. 18 shows diagrammatically a different arrangement of the same unit 11. A series of conduits is recessed in the upper face of a lower plate 72 and these conduits solely open onto the lower face of this plate by way of vertical conduits not seen in the drawing. The unit also comprises an intermediate plate 73 which also has in its lower face a system of conduits and a cavity receiving the check valve 67. Recessed in the upper face of the plate 73 and in the lower face of an upper plate 74 are semi-cavities, the assembly of which defines the bores for the four directional valves 22, 57, 61 and 62 and a cavity for the check valve 18.

The unit 11 is completed by a gasket 75 which is sealingly interposed between the lower plate 72 and intermediate plate 73. This gasket is provided with a series of orifices 76 which provide the desired communications between the conduits of the plate 72 and those of the plate 73. Thus it is sufficient to change the gasket 75, for example, from the control of FIG. 14 to that of FIG. 15 without need for any plug for the orifices of the unused conduits. The closing action of the gasket 75 moreover enables the slide member of the unused directional valves to be eliminated.

FIG. 19 shows a latch 2 in which there is incorporated a pump 56 indicating a non-latched door. Pivotally mounted on the unlatching means 3 for latching the fork member 77 which hooks onto the keeper (not shown) is the rod 4 which extends into a cylindrical socket 79 depending from the case 80 of the latch. This rod bears by its end against an unrolling diaphragm 81 whose periphery is clamped between an end shoulder of the socket 79 and a closing element 82. The latter is provided with a pipe 83 for connection to a flexible pipe 83*a* leading to the unit 11. The elements 4, 79, 81 and 82 constitutes the unlatching shifting device or fluid motor 5.

The periphery of the fork member 77 constitutes a cam against which bears a finger member 83 which is guided in the case 80 and biased by a spring 84. Pivotally mounted on the base of the finger member 83 is one end portion of a lever 85 which is pivotally mounted in an intermediate portion of the lever on a pin 86 of the case 80 which is parallel to the pivot pin 87 of the fork member 77. The other end portion of the lever 85 merely bears against a closed end portion of a bellows 88 which has an open opposite end secured to the case 80 around an orifice 89 formed in the latter. A flexible pipe 90 is connected to the orifice 89 and to the unit 11 so that the elements 83 to 86 and 88 constitute the pump 56.

When the latch is completely latched as illustrated, the finger member 83 is urged by the fork member 77 and compresses the spring 84 so that the bellows 88 is expanded. Upon unlatching, the fork member 77, released by the latching means 3 under the action of the fluid motor 5, rotates in the clockwise direction (as viewed in FIG. 19) and releases the finger member 83 and the spring 84. The latter thus also rotates the lever 85 in the clockwise direction and causes the compression of the bellows 88. At the end of the latching of the latch, the finger member 83 is suddenly urged back so that the free end of the lever 85 moves away from the bellows 88. The latter thus returns to the expanded state merely under the effect of the pressure of the liquid contained in the circuit 6, if this pressure is higher than atmospheric pressure. If this is not so, this return of the bellows may be ensured by a second spring (not shown) which is softer than the spring 84. Consequently, the sudden changes in position of the fork member 77 do not act directly on the bellows 88 and are not liable to deteriorate the latter.

The finger member 83 may of course be also connected to a warning system, for example a warning light, indicating an incompletely closed door.

FIG. 20 shows an embodiment of hydraulic actuating devices. The two locking pumps 12 and 13 are bellows respectively connected to the cylinder of the key 14 and to the pull-member 15 since they do not have to withstand high pressures and are solely intended to shift the slide valve members of the locking directional valves. On the other hand, the unlatching pump 7 is of the unrolling diaphragm type which is much more sturdy since this pump must transmit to the fluid motor 5 the force required to shift the latching means 3 of the latch.

In the various completely hydraulic controls described hereinbefore, there are obtained to the highest degree the aforementioned advantages that hydraulic devices have over mechanical or electromechanical devices, to which are added the possibilities of standardization, lightness and small overall size (all of the component parts may be of plastics material and of very small size) and remote amplification of forces. However, it will be understood that these advantages may only be obtained to a smaller degree by rendering a part of the control mechanical or electromechanical, for example the means actuating one or more slide valve members of the locking directional valves. Thus the directional valve 57 may be actuated by a rod provided on the edge of a rear door, and the directional valve 22 may be actuated by an electro-magnet of a centralized electric locking device. The actuating means of the directional valves may moreover be very easily duplicated. Further, it is possible to provide the latch with a hydraulically controlled mechanical locking device, this device being associated with a device which is also mechanical or hydraulic for unlatching the latch.

Having now described our invention what we claim as new and desire to secure by Letters Patent is:

1. A latch, in particular for an automobile vehicle door, comprising:

inner and outer devices for controlling the unlatching of the latch wherein the devices are part of a closed hydraulic circuit and each comprises at least one unlatching control pump;

a device for locking the latch, the locking device comprising a first directional valve inserted in the circuit between said outer unlatching control pump and a means for unlatching the latch;

a closed hydraulic circuit containing a liquid, said hydraulic circuit further comprising an expansion vessel and a check valve, which valve is associated with the vessel and is adapted to permit the return of said liquid to the vessel only at very low flows;

priority actuating means in combination with the first directional valve, the priority actuating means operative in response to the position occupied by the latching means of the latch;

a second directional valve having a neutral position; and, means associated with said second valve for returning said second valve elastically to said neutral position, said second directional valve being inserted between said outer device and the first directional valve and mounted in such manner as to be shifted by actuating means for said second directional valve when, and only when, said priority actuating means are in a state corresponding to the unlatched or incompletely latched state of the latch, and to then connect said outer device to a latching end of the first directional valve.

2. A latch according to claim 1, wherein the first directional valve connects said outer control pump directly to the expansion vessel in a locking position.

3. A latch according to claim 2, wherein the first directional valve is associated with an actuating pump.

4. A latch according to claim 3, further comprising:

a constricted branch conduit connecting the actuating pump of the first directional valve directly to the expansion vessel;

the first directional valve having a slide member;

a device associated with the slide member for maintaining the slide member in either one of two stable positions; and, actuating means of the actuating pump being provided with means for an elastic return thereof to a middle stable position.

5. A latch according to claim 1, further comprising a third directional valve inserted in the circuit between the inner unlatching control pump and the means for unlatching the latch; and, actuating means for the third directional valve.

6. A latch according to claim 1, wherein the priority actuating means are hydraulic and comprise pressure limiting means.

* * * * *